US010408159B2

(12) United States Patent
Amano

(10) Patent No.: US 10,408,159 B2
(45) Date of Patent: Sep. 10, 2019

(54) CYLINDER BLOCK OF INTERNAL COMBUSTION ENGINE AND CYLINDER BLOCK MANUFACTURING METHOD

(71) Applicant: TOYOTA JIDOSHA KABUSHIKI KAISHA, Toyota-shi, Aichi-ken (JP)

(72) Inventor: Takashi Amano, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/684,195

(22) Filed: Aug. 23, 2017

(65) Prior Publication Data

US 2018/0058370 A1 Mar. 1, 2018

(30) Foreign Application Priority Data

Aug. 29, 2016 (JP) ..... 2016-167075

(51) Int. Cl.

| | |
|---|---|
| ***F02F 1/00*** | (2006.01) |
| ***F02F 1/10*** | (2006.01) |
| ***F02F 7/00*** | (2006.01) |
| ***F02F 1/18*** | (2006.01) |

(52) U.S. Cl.

CPC ..... *F02F 1/10* (2013.01); *F02F 1/004* (2013.01); *F02F 1/18* (2013.01); *F02F 7/0007* (2013.01); *F02F 7/0085* (2013.01); *F02F 2200/00* (2013.01)

(58) Field of Classification Search

CPC .. F02F 1/004; F02F 1/18; F02F 7/0007; F02F 7/0085; F02F 2200/00

USPC ..... 123/193.2

See application file for complete search history.

(56) References Cited

U.S. PATENT DOCUMENTS

| | | | | |
|---|---|---|---|---|
| 8,651,083 | B2 * | 2/2014 | Izawa | C23C 4/12 123/193.2 |
| 2002/0148430 | A1 * | 10/2002 | Kano | F02F 1/10 123/193.2 |
| 2007/0012176 | A1 | 1/2007 | Takami et al. | |
| 2007/0012177 | A1 | 1/2007 | Miyamoto et al. | |
| 2007/0012179 | A1 | 1/2007 | Takami et al. | |
| 2007/0012180 | A1 * | 1/2007 | Miyamoto | B22D 19/0009 92/171.1 |
| 2015/0020757 | A1 * | 1/2015 | Highum | B22D 19/0081 123/41.01 |
| 2015/0267636 | A1 * | 9/2015 | Nagai | F01P 3/02 123/41.72 |
| 2015/0300288 | A1 * | 10/2015 | Miwa | C23C 4/02 29/888.061 |

FOREIGN PATENT DOCUMENTS

| | | | |
|---|---|---|---|
| DE | 10338386 | B3 | 12/2004 |
| JP | 58-77141 | A | 5/1983 |
| JP | 58-85341 | A | 5/1983 |

(Continued)

*Primary Examiner* — Marguerite J McMahon

(74) *Attorney, Agent, or Firm* — Finnegan, Henderson, Farabow, Garrett & Dunner, LLP

(57) ABSTRACT

A cylinder block of an internal combustion engine includes a cylinder bore wall that holds a piston so as to allow the piston to reciprocate. In at least one part of the cylinder bore wall in a cylinder axial direction, the density of a layer located farther from a cylinder head is lower than the density of a layer located closer to the cylinder head in the cylinder axial direction.

4 Claims, 8 Drawing Sheets

(56) References Cited

FOREIGN PATENT DOCUMENTS

| | | | |
|---|---|---|---|
| JP | 6-22547 | | 3/1994 |
| JP | 09-158777 | A | 6/1997 |
| JP | 2002-018567 | A | 1/2002 |
| JP | 2007-16734 | | 1/2007 |
| JP | 2007-16735 | | 1/2007 |
| JP | 2007-16736 | | 1/2007 |
| JP | 2007-297923 | | 11/2007 |
| JP | 2014-105619 | A | 6/2014 |
| KR | 10-2008-0027927 | A | 3/2008 |
| WO | WO2007/007823 | A1 | 1/2007 |

* cited by examiner

CYLINDER BLOCK OF INTERNAL COMBUSTION ENGINE AND CYLINDER BLOCK MANUFACTURING METHOD

INCORPORATION BY REFERENCE

The disclosure of Japanese Patent Application No. 2016-167075 filed on Aug. 29, 2016 including the specification, drawings and abstract is incorporated herein by reference in its entirety.

BACKGROUND

1. Technical Field

The present disclosure relates to a cylinder block of an internal combustion engine and a cylinder block manufacturing method.

2. Description of Related Art

Japanese Utility Model Application Publication No. 6-22547 (JP 6-22547 U) discloses an internal combustion engine having a heat shield structure that prevents heat inside a combustion chamber from escaping to the lower side of a cylinder block. Specifically, in the internal combustion engine of JP 6-22547 U, a material having low heat conductivity is disposed between a head liner located on a cylinder head side and a cylinder liner located on a cylinder block side.

SUMMARY

When it comes to the cylinder bore wall of a cylinder block, the configuration described in JP 6-22547 U may fail to suppress heat conduction from a side closer to the cylinder head toward a side farther from the cylinder head in a cylinder axial direction.

The present disclosure provides a cylinder block of an internal combustion engine in which heat conduction inside the cylinder bore wall from the side closer to the cylinder head toward the side farther from the cylinder head in the cylinder axial direction can be suppressed, and a cylinder block manufacturing method.

A first aspect of the present disclosure is a cylinder block of an internal combustion engine. The cylinder block includes a cylinder bore wall. The cylinder bore wall is capable of holding a piston such that the piston reciprocates. At least one part of the cylinder bore wall in a cylinder axial direction includes a plurality of layers that are different from one another in density. The plurality of layers includes a first layer and a second layer. The first layer is located closer to a cylinder head in the cylinder axial direction. The second layer is located farther from the cylinder head and has a lower density than the first layer.

In the cylinder block, the cylinder bore wall may include a cylinder liner. The at least one part of the cylinder bore wall may be at least one part of the cylinder liner in the cylinder axial direction.

The cylinder block may have a water jacket through which engine coolant flows. The cylinder bore wall may include a cylinder liner and a main wall. The main wall may be located on an outer circumferential side of the cylinder liner and on an inner side of the water jacket in a cylinder radial direction. The at least one part of the cylinder bore wall may be at least one part of the main wall in the cylinder axial direction.

In the cylinder block, in the at least one part of the cylinder bore wall in the cylinder axial direction, the density may decrease stepwise as the distance from the cylinder head increases.

In the cylinder block, a highest-density layer may be provided farthest on the side closer to the cylinder head in the at least one part in the cylinder axial direction. The cylinder bore wall may include a low-density layer that is located farther on the side closer to the cylinder head than the at least one part in the cylinder axial direction. The low-density layer may have a lower density than the highest-density layer. The low-density layer may be made of the same material as the highest-density layer.

A second aspect of the present disclosure is a cylinder block manufacturing method. The cylinder block includes a cylinder bore wall that holds a piston so as to allow the piston to reciprocate. At least one part of the cylinder bore wall in a cylinder axial direction includes a plurality of layers that are different from one another in density. The plurality of layers includes a first layer and a second layer. The first layer is located closer to a cylinder head in the cylinder axial direction. The second layer is located farther from the cylinder head and has a lower density than the first layer. The cylinder block manufacturing method includes: forming one layer of the cylinder bore wall, as a one layer formation step, by repeating an action of moving a molding head of a three-dimensional molding machine back and forth in a direction of an X-axis while moving the molding head in a direction of a Y-axis; and repeatedly performing the one layer formation step, as a lamination step, such that the layers of the cylinder bore wall are laminated in a direction of a Z-axis and such that the density of the second layer is lower than the density of the first layer in a portion to be varied in density of the layers. The one layer formation step and the lamination step are a molding step. The molding step is a step of molding the cylinder bore wall in a three-dimensional space defined by the X-axis, the Y-axis, and the Z-axis. The direction of the Z-axis is parallel to the cylinder axial direction.

The cylinder block according to the cylinder block manufacturing method may have a water jacket through which engine coolant flows. The cylinder bore wall may include a cylinder liner. A portion of the cylinder bore wall for which the molding step is performed may be the cylinder liner. The cylinder block manufacturing method may further include incorporating the cylinder liner into the cylinder bore wall, a liner incorporation step, so that, when the cylinder liner is seen from the cylinder axial direction, the cylinder liner faces the water jacket at positions of two points at which a straight line passing through a cylinder bore center and parallel to the X-axis and an outer circumference of the cylinder liner intersect with each other.

In the cylinder block according to the cylinder block manufacturing method, the cylinder bore wall may further include a main wall. The main wall may be located on an outer circumferential side of the cylinder liner, on an inner side of the water jacket in a cylinder radial direction. A portion of the cylinder bore wall for which the molding step is performed may be the main wall. The direction of the X-axis may be set so that, when the main wall is seen from the cylinder axial direction, the main wall faces the water jacket at positions of two points at which a straight line passing through a cylinder bore center and parallel to the X-axis and an outer circumference of the main wall intersect with each other.

If the density of the cylinder bore wall is low, the heat conductivity of the cylinder bore wall is low. In the present disclosure, at least one part of the cylinder bore wall in the cylinder axial direction is configured so that the density of the layer located farther from the cylinder head is lower than the density of the layer located closer to the cylinder head in the cylinder axial direction. According to the present disclosure, it is possible to suppress heat conduction inside the cylinder bore wall from the side closer to the cylinder head toward the side farther from the cylinder head in the cylinder axial direction by thus varying the density of the cylinder bore wall in the cylinder axial direction.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
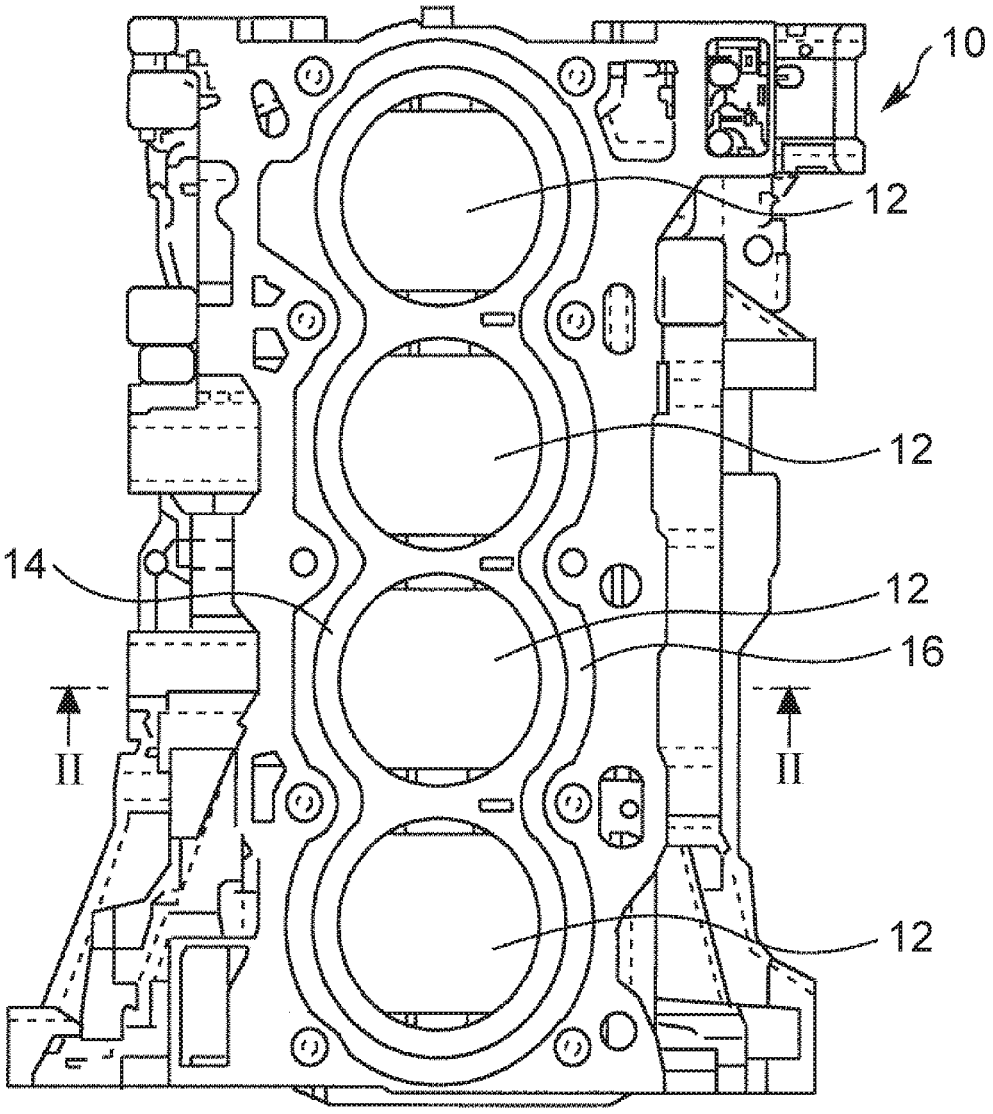
FIG. 1 is a view of a cylinder block of an internal combustion engine according to Embodiment 1, as looked down from a cylinder head side in a cylinder axial direction.

Embodiments of the present disclosure will be described below with reference to the drawings. The present disclosure is not limited to the embodiments shown below but can be implemented with various modifications made thereto within the scope of the gist of the disclosure. As far as possible, examples described in the embodiments and other modified examples can be appropriately combined otherwise than in the combinations explicitly shown herein. In the drawings, the same or similar components are given the same reference signs.

Embodiment 1

Configuration of Cylinder Block of Embodiment 1

FIG. 1 is a view of a cylinder block 10 of an internal combustion engine according to Embodiment 1 of the present disclosure, as looked down from the side of a cylinder head 18 (see FIG. 2) in a cylinder axial direction. For example, the cylinder block 10 shown in FIG. 1 is intended for an in-line four-cylinder engine and includes four cylinder bores 12 arrayed in a row.

The cylinder block 10 includes a cylinder bore wall 14 that is a portion forming the cylinder bores 12. The cylinder bore wall 14 holds a piston 2 (see FIG. 2) inserted into each cylinder bore 12 so as to allow the piston 2 to reciprocate. The cylinder block 10 further includes a water jacket 16 which is formed so as to surround the cylinder bore wall 14 and through which engine coolant is circulated. In this embodiment, the portion located on an inner side of the water jacket 16 in a cylinder radial direction when the cylinder block 10 is seen from the cylinder axial direction is referred to as the cylinder bore wall 14.

More specifically, in the example shown in FIG. 1, the cylinder bore wall 14 has a structure in which wall parts respectively forming the four cylinder bores 12 are integrally coupled to one another (so-called a Siamese structure). When the cylinder block 10 is seen from the cylinder axial direction, the water jacket 16 is formed so as to surround the entire circumference of the cylinder bore wall 14 thus integrally coupled, along the shape of the cylinder bore wall 14. Accordingly, in the example shown in FIG. 1, the water jacket 16 is formed so as to surround a portion in a cylinder circumferential direction, and not the entire circumference, of each part of the cylinder bore wall 14.

Figure 2:
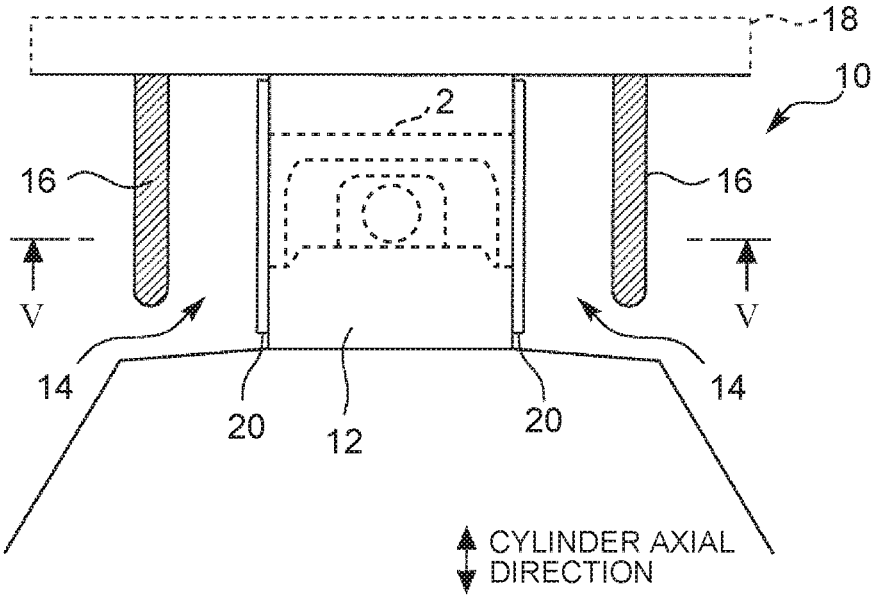
FIG. 2 is a view schematically representing a sectional shape of the cylinder block cut along the line II-II indicated in FIG. 1.

FIG. 2 is a view schematically representing a sectional shape of the cylinder block 10 cut along the line II-II indicated in FIG. 1. The line II-II passes through the center of the cylinder bore 12 as seen from the cylinder axial direction.

As shown in FIG. 2, the cylinder bore wall 14 of this embodiment includes a cylindrical cylinder liner 20 to form the cylinder bore 12. Accordingly, an inner circumferential surface of the cylinder liner 20 functions as a circumferential surface of the cylinder bore 12. The cylinder liner 20 corresponds to a range of sliding of the piston 2 in the cylinder axial direction, and is formed so as to extend along almost the entire cylinder bore 12. In the example shown in FIG. 2, the water jacket 16 is formed so as to surround a portion of the cylinder bore wall 14 (more specifically, a portion on the side closer to the cylinder head 18) in the cylinder axial direction.

Figure 3:
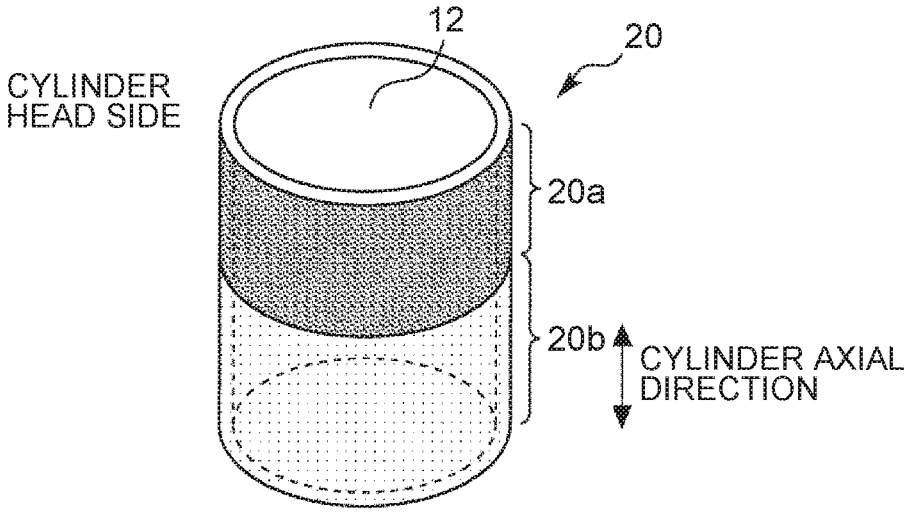
FIG. 3 is a perspective view representing a cylinder liner shown in FIG. 2.

FIG. 3 is a perspective view representing the cylinder liner 20 shown in FIG. 2. As shown in FIG. 3, the cylinder liner 20 has a two-layer structure composed of a high-density layer 20*a* having a higher density and a low-density layer 20*b* having a lower density than the high-density layer 20*a* (in other words, a higher porosity than the high-density layer 20*a*). The high-density layer 20*a* is provided on the side closer to the cylinder head 18 in the cylinder axial direction, and the low-density layer 20*b* is provided on the side farther from the cylinder head 18 relative to the high-density layer 20*a*. Because of this structure, in the cylinder liner 20 as a whole in the cylinder axial direction, the density of the layer located farther from the cylinder head 18 (i.e., the low-density layer 20*b*) is lower than the density of the layer located closer to the cylinder head 18 (i.e., the high-density layer 20*a*). The high-density layer 20*a* and the low-density layer 20*b* are integrally formed. The high-density layer 20*a* is an example of a first layer. The low-density layer 20*b* is an example of a second layer.

The cylinder block 10 including other portions than the cylinder liner 20 of the cylinder bore wall 14 is made of a metal material (e.g., an aluminum alloy). Similarly, the cylinder liner 20 is also made of a metal material (e.g., an aluminum alloy). The high-density layer 20*a* and the low-density layer 20*b* are formed as two layers that are made of the same material but different from each other in density in the cylinder axial direction. For example, the density of the high-density layer 20*a* is equivalent to the density of the cylinder bore wall 14 located on an outer circumferential side of the cylinder liner 20.

In the example shown in FIG. 3, the high-density layer 20*a* and the low-density layer 20*b* are provided to the same thickness (the thickness in the cylinder axial direction). However, the ratio between the thicknesses of the high-density layer 20*a* and the low-density layer 20*b* is not limited to 1:1, and the high-density layer 20*a* may be formed so as to be thicker than the low-density layer 20*b* as necessary. Conversely, the high-density layer 20*a* may be formed so as to be thinner than the low-density layer 20*b*.

In the example shown in FIG. 3, the thickness of the high-density layer 20*a* in the cylinder radial direction is the same as the thickness of the low-density layer 20*b*. In this connection, to compensate for the reduced strength of the low-density layer 20*b* compared with the high-density layer 20*a* due to the reduced density, the thickness of the low-density layer 20*b* in the cylinder radial direction may be set to be larger than that of the high-density layer 20*a*. More specifically, for example, the thickness of the low-density layer 20*b* in the cylinder radial direction may be set to be larger as the difference in density is larger. A hardening treatment may be performed on an inner circumferential surface of the cylinder liner 20 to improve the wear resistance.

Manufacturing Method of Cylinder Block of Embodiment 1

A manufacturing method of the cylinder block 10 of this embodiment uses a three-dimensional molding machine to manufacture the cylinder liner 20 with the density varying in the cylinder axial direction. The three-dimensional molding machine divides three-dimensional data on a three-dimensional object to be molded (in this embodiment, the cylinder liner 20) into a plurality of layers in a predetermined direction (in this embodiment, a direction of a Z-axis to be described later), and laminates layers of a molding material (in this embodiment, an aluminum alloy) from a lowermost layer on the basis of shape data on each layer. Thus, the three-dimensional molding machine forms the object to be molded according to the three-dimensional data. On the other hand, the other portions of the cylinder block 10 than the cylinder liner 20 are manufactured using casting. This means that, in this embodiment, the other portions of the cylinder bore wall 14 than the cylinder liner 20 are not manufactured so as to vary in density in the cylinder axial direction.

The manufacturing method of this embodiment includes a molding step of molding the cylinder liner 20 using the three-dimensional molding machine, and a liner incorporation step of incorporating the cylinder liner 20 into the cylinder bore wall 14. These steps will be described in detail below.

Cylinder Liner Molding Step

Figure 4:
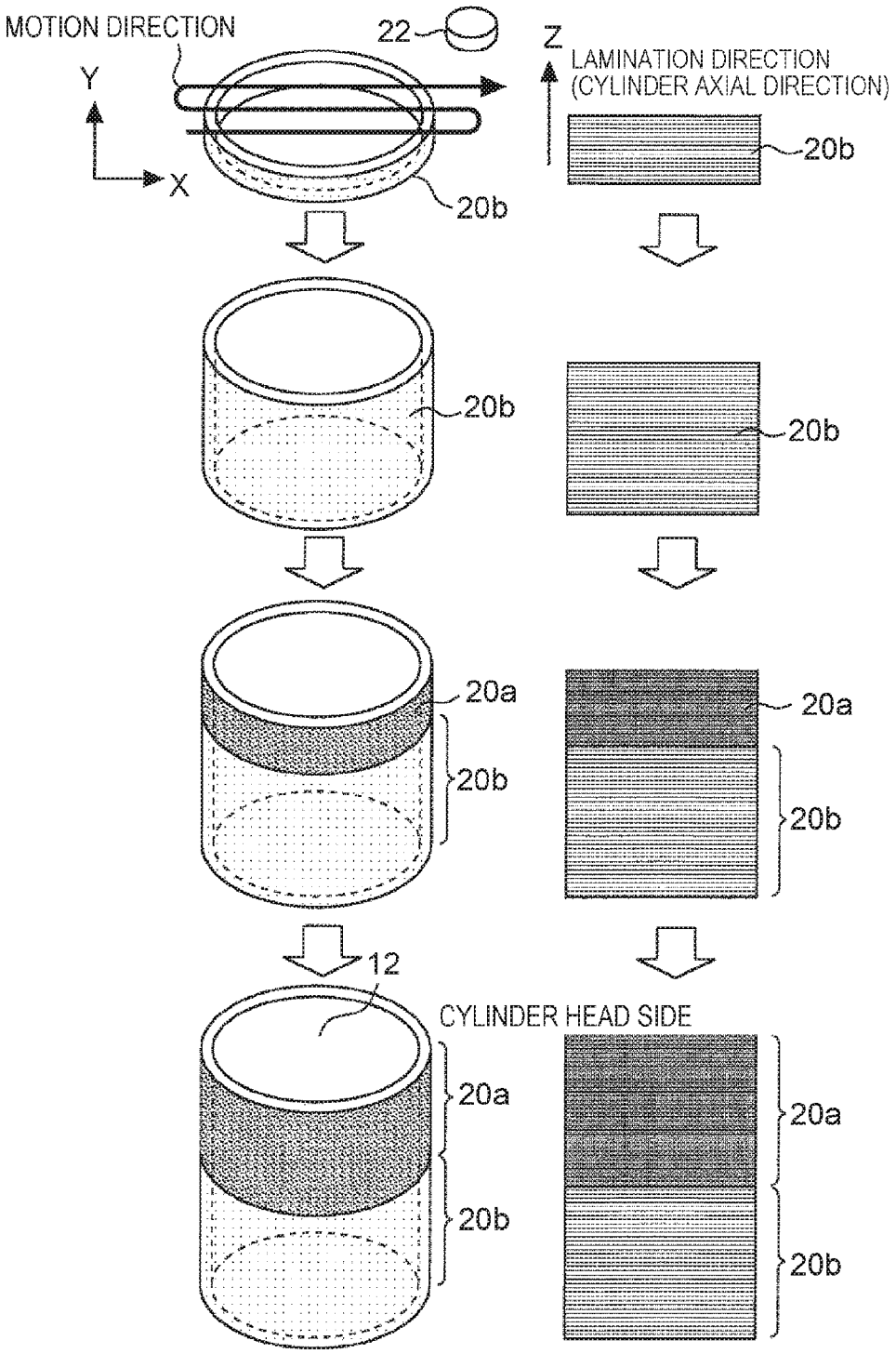
FIG. 4 is a chart illustrating the flow of a cylinder liner molding step.

FIG. 4 is a chart illustrating the flow of the molding step of the cylinder liner 20. FIG. 4 includes a perspective view (left) representing the process of molding the cylinder liner 20, and a view (right) of the cylinder liner 20 at each stage of the molding step as seen from a Y-axis direction. The molding step is a step of molding the cylinder liner 20 in a three-dimensional space defined by the X-, Y-, and Z-axes indicated in FIG. 4. The Z-axis direction is parallel to the cylinder axial direction.

The molding step includes a one layer formation step and a lamination step. First, the one layer formation step will be described. Although the type of the three-dimensional molding machine used in the molding step is not limited, for example, the following type of machine is used in this embodiment. The three-dimensional molding machine used includes a molding head 22 (see FIG. 4) having a nozzle for injecting a metal powder being the material of the cylinder liner 20 and a laser beam source for applying a laser beam to thermally compact the injected metal powder.

In the one layer formation step, the molding head 22 repeats an action of moving back and forth in the X-axis direction while moving in the Y-axis direction as indicated as "motion direction" in FIG. 4, in an XY-plane within a predetermined area encompassing the cylinder liner 20. When the molding head 22 while performing this action comes to a position at which the cylinder liner 20 needs to be molded, the molding head 22 injects the metal powder through the nozzle and applies a laser beam to the injected metal powder. Information on positions at which the cylinder liner 20 needs to be molded is acquired on the basis of the three-dimensional data. According to this one layer formation step, one layer of the cylinder liner 20 can be formed. Instead of the above-described type of three-dimensional molding machine, for example, another type of three-dimensional molding machine may be used that includes a device for spreading an amount of metal powder corresponding to one layer, layer by layer, and a molding head having only a laser beam source, and that applies a laser beam to only those positions at which the cylinder liner 20 needs to be molded.

Next, the lamination step is a step of repeatedly performing the one layer formation step in the following manner. In the lamination step, each time one layer has been formed, the molding head 22 is moved a predetermined feed pitch in the Z-axis direction, and then the one layer formation step is performed to form the next layer. The feed pitch corresponds to the thickness of one layer. In the example shown in FIG. 4, lamination progresses from the side farther from the cylinder head 18 toward the side closer to the cylinder head 18 in the Z-axis direction (cylinder axial direction). Here, lamination in the lamination step is performed so that the layers of the cylinder liner 20 formed by performing the one layer formation step are laminated in the Z-axis direction in such a manner that the density of the layer located farther from the cylinder head 18 (i.e., the low-density layer 20*b*) is lower than the density of the layer located closer to the cylinder head 18 (i.e., the high-density layer 20*a*). Thus, according to this lamination step, the low-density layer 20*b* is formed first and then the high-density layer 20*a* is formed as shown in FIG. 4. In the cylinder liner 20 of this embodiment, all the layers of the cylinder liner 20 formed by performing the one layer formation step are an example of the "portion to be varied in density" as termed in the present disclosure.

The density of the layers can be varied in the Z-axis direction by changing the filling ratio of the metal powder in the nozzle of the molding head 22. More specifically, for example, when the filling ratio in the nozzle is reduced, the ratio of voids (porosity) occupying a layer produced by thermally compacting the metal powder through application of a laser beam increases, i.e., the density of the layer decreases. Therefore, two layers that are different from each other in density can be formed by increasing the filling ratio in the nozzle when lamination progresses and the object to be molded switches from the low-density layer 20*b* to the high-density layer 20*a*.

Liner Incorporation Step

The liner incorporation step is a step of incorporating the cylinder liner 20 manufactured by the above molding step into the cylinder bore wall 14. In this embodiment, for example, the cylinder liner 20 is incorporated into the cylinder bore wall 14 by being cast inside a casting mold of the cylinder block 10 when the other portions of the cylinder block 10 than the cylinder liner 20 are manufactured by casting. However, the technique of incorporating the cylinder liner into the cylinder bore wall is not limited to this one, and, for example, the cylinder liner may be incorporated into the cylinder bore wall by press fitting.

Figure 5:
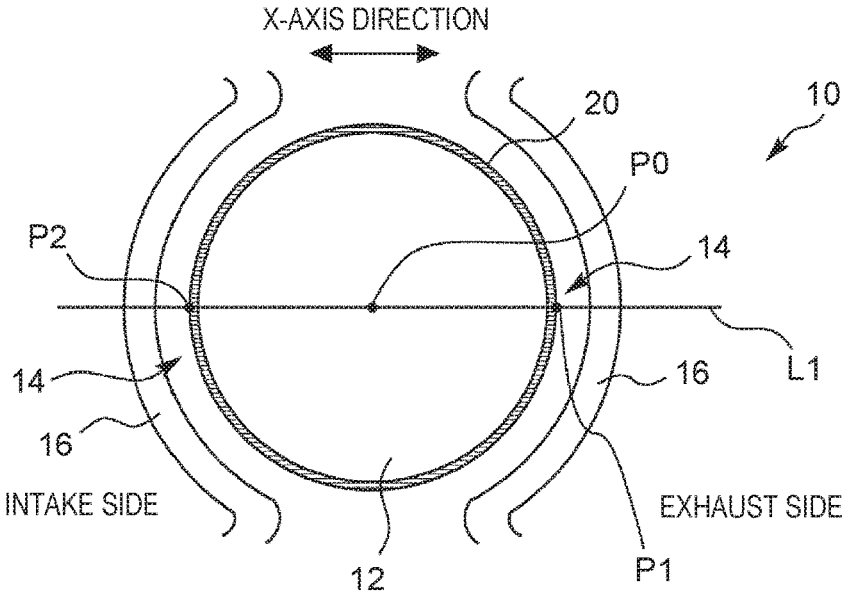
FIG. 5 is a view representing a sectional shape of the cylinder block cut along the line V-V indicated in FIG. 2.

FIG. 5 is a view representing a sectional shape of the cylinder block 10 cut along the line V-V indicated in FIG. 2. The liner incorporation step of this embodiment is performed in the following manner. According to this liner incorporation step, the cylinder liner 20 is incorporated into the cylinder bore wall 14 so that, when the cylinder liner 20 is seen from the cylinder axial direction as shown in FIG. 5, the cylinder liner 20 faces the water jacket 16 at the positions of two points P1, P2 at which a straight line (imaginary line) L1 passing through a cylinder bore center P0 and parallel to the X-axis and the outer circumference of the cylinder liner 20 intersect with each other.

To add further details, the example shown in FIG. 5 is an example of the case where the cylinder liner 20 is incorporated into the cylinder bore wall 14 in the above-described manner. In this example, the cylinder liner 20 is incorporated into the cylinder bore wall 14 so that a direction connecting an intake side and an exhaust side of the internal combustion engine (a direction orthogonal to an array direction of the cylinder bores 12 as seen from the cylinder axial direction) and the X-axis direction during molding of the cylinder liner 20 are parallel to each other.

Effects of Embodiment 1

Figure 6:
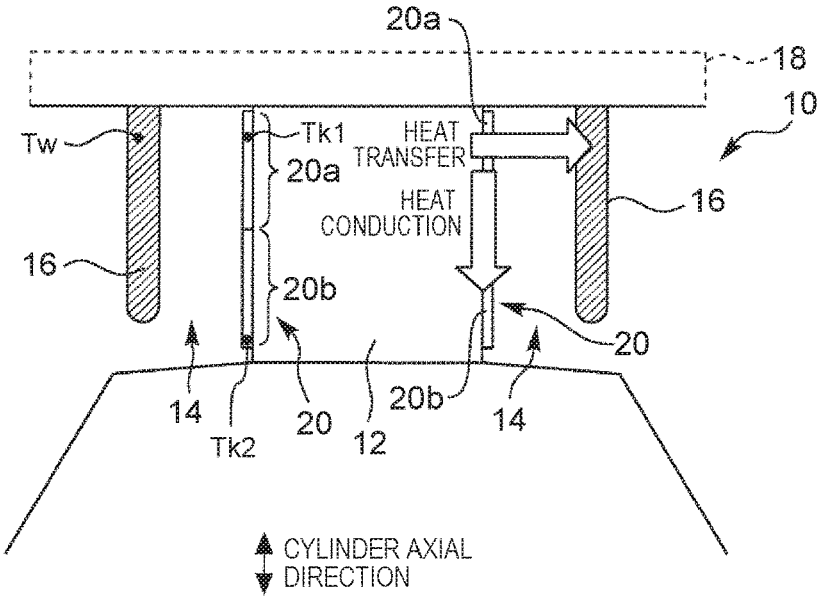
FIG. 6 is a view illustrating effects of the cylinder block according to Embodiment 1.

FIG. 6 is a view illustrating effects of the cylinder block 10 according to Embodiment 1 of the present disclosure, and represents the same section as FIG. 2. The cylinder liner 20 of this embodiment has the two-layer structure composed of the high-density layer 20*a* provided on the side closer to the cylinder head 18 and the low-density layer 20*b* provided on the side farther from the cylinder head 18 in the cylinder axial direction. If the density of the cylinder liner 20 is low (i.e., the porosity is high), the heat conductivity of the cylinder liner 20 is low. Heat from combustion gas is transferred to the cylinder bore wall 14 mainly on the side closer to the cylinder head 18. According to the cylinder bore wall 14 including the cylinder liner 20 having the above-described two-layer structure, heat conduction (see the arrow in FIG. 6) from the side closer to the cylinder head 18 toward the side farther from the cylinder head 18 in the cylinder axial direction can be suppressed.

Moreover, according to the cylinder block 10 of this embodiment, as the heat conduction in the cylinder axial direction can be suppressed, a cylinder bore wall temperature Tk1 at an end on the side closer to the cylinder head 18 can be more easily raised at an early point during warming up of the internal combustion engine. As the temperature of an oil film between the circumferential surface of the cylinder bore 12 (the inner circumferential surface of the cylinder liner 20) and the piston 2 rises accordingly, friction therebetween can be reduced. Furthermore, suppressing the heat conduction in the cylinder axial direction also contributes to promoting heat transfer toward the outer side in the cylinder radial direction (i.e., heat transfer from the cylinder bore wall 14 to the water jacket 16) at a portion on the side closer to the cylinder head 18. As has been described above, according to the configuration of this embodiment, a cylinder block structure can be obtained that can enhance the ability of the internal combustion engine to quickly warm up using less heat energy.

The improving effect on the heat transfer from the cylinder bore wall 14 to the water jacket 16 (i.e., to the engine coolant) is advantageous also after warming up of the internal combustion engine in the following respect. As the heat transfer to the coolant is improved, the cylinder bore wall temperature Tk1 can be more easily reduced during high-load operation of the internal combustion engine, so that the resistance to knocking can be improved. Thus, the cylinder block structure of this embodiment can favorably achieve improvement of both the ability of quick warming up and the cooling performance after warming up.

Figure 7:
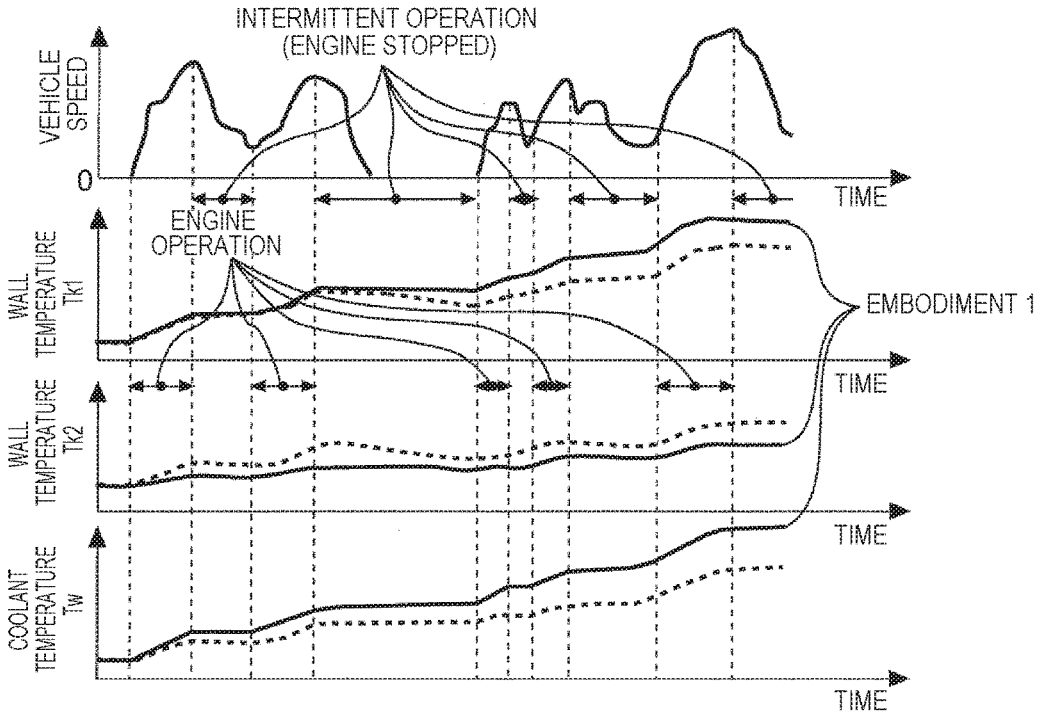
FIG. 7 is a time chart representing an example of behaviors of temperatures of an internal combustion engine rising from a cold state in a hybrid electric vehicle that can run with the internal combustion engine under intermittent operation control.

Next, an example of a situation where the effects of the cylinder block structure of this embodiment can be exhibited will be described with reference to FIG. 7. FIG. 7 is a time chart representing an example of behaviors of temperatures of an internal combustion engine rising from a cold state in a hybrid electric vehicle (a vehicle having an internal combustion engine and an electric motor as driving sources) that can run with the internal combustion engine under intermittent operation control. As shown in FIG. 6, reference sign Tk2 denotes a cylinder bore wall temperature at an end on the side farther from the cylinder head 18, and reference sign Tw denotes the temperature of coolant inside the water jacket 16. The solid lines in FIG. 7 correspond to a vehicle that employs the cylinder block structure of this embodiment, and the dashed lines in FIG. 7 correspond to a vehicle that does not employ the cylinder block structure of this embodiment.

According to intermittent operation control, as shown in FIG. 7, the operation of the internal combustion engine is performed during an acceleration period of the vehicle and stopped during a deceleration period of the vehicle. During a period when the vehicle speed is zero and the vehicle is stopped, too, the operation of the internal combustion engine is stopped (idling stop). The following characteristics attributable to the suppressing effect on heat conduction in the cylinder axial direction brought about by adopting the cylinder block structure of this embodiment can be seen from the time chart shown in FIG. 7. According to the solid-line curve of the cylinder bore wall temperature Tk1 of FIG. 7, compared with the dashed-line curve thereof, the temperature Tk1 rises easily during engine operation and the temperature Tk1 does not easily decrease during engine stop. The same characteristics can also be seen from a comparison between the solid-line and dashed-line curves of the temperature Tk2 on the side farther from the cylinder head 18. According to the solid-line curve of the temperature Tk2, compared with the dashed-line curve thereof, the rise of the temperature Tk2 is suppressed during engine operation and engine stop. Moreover, according to the solid-line curve of the coolant temperature Tw, compared with the dashed-line curve thereof, the coolant temperature Tw rises easily during engine operation as with the temperature Tk1. This quickening effect on the rise of the coolant temperature Tw brings with it other effects such as promoting the temperature rise of components of the internal combustion engine that require warming up (e.g., an EGR cooler) and improving the vehicle interior heating performance. Furthermore, according to the cylinder block structure of this embodiment, the decrease of the temperature Tk1 can be suppressed also in the case where idling operation in which a smaller amount of heat is generated is performed unlike in the example shown in FIG. 7. In addition, the cylinder block structure of this embodiment is also compatible with water circulation stop control that involves stopping circulation of water to the cylinder block during engine warming up. That is, stopping water circulation can enhance the quickening effect on the rise of the temperature Tk1 during engine warming up.

As described above, in this embodiment, the cylinder liner 20 having the two-layer structure with the density varying in the cylinder axial direction is molded by the molding step using the three-dimensional molding machine. The cylinder liner 20 having this structure can also be manufactured, for example, by sintering, without using the three-dimensional molding machine. Specifically, it is also possible to vary the density of the cylinder liner in the cylinder axial direction by changing the degree of filling of a metal powder when thermally compacting the metal powder by sintering. However, the cylinder liner can be manufactured more easily by using the three-dimensional molding machine than by sintering.

According to the above molding step, the molding head 22 is moved back and forth in the X-axis direction in each layer of the cylinder liner 20. As a result of this action of the molding head 22, when the cylinder liner 20 is seen in a section in the cylinder axial direction, the layers are formed in a stripe pattern composed of straight lines parallel to the X-axis as conceptually represented in FIG. 5. In the cylinder liner 20 having such a section, the heat conductivity from the inner circumferential side toward the outer circumferential side is higher in a direction parallel to the X-axis than in a direction orthogonal to the X-axis (i.e., heat is transferred so as to cross each straight line of the stripe pattern). In this connection, according to the liner incorporation step of this embodiment, the cylinder liner 20 is incorporated into the cylinder bore wall 14 in such a manner that the cylinder liner 20 faces the water jacket 16 at the positions of the two points P1, P2 at which the straight line L1 passing through the cylinder bore center P0 and parallel to the X-axis and the outer circumference of the cylinder liner 20 intersect with each other as shown in FIG. 5. Thus, heat transfer toward the outer side in the cylinder radial direction can be effectively promoted at a portion where this heat transfer is desired to be promoted (in the cylinder liner 20, that portion is the high-density layer 20*a* provided on the side closer to the cylinder head 18).

In Embodiment 1 described above, the low-density layer 20*b* and the high-density layer 20*a* are laminated in this order in the lamination step. However, the high-density layer 20*a* and the low-density layer 20*b* may be laminated in this order by setting the Z-axis direction to the opposite direction from that in the above example. The density of the layers of the cylinder liner 20 can also be varied, for example, by changing the feed pitch instead of the filling ratio in the nozzle. Specifically, for example, the density of one layer can be set to be higher than the density of another layer by setting the feed pitch in the one layer to be shorter than that in the other layer. Thus, to vary the density, the feed pitch may be adjusted in addition to or instead of adjusting the filling ratio in the nozzle.

In Embodiment 1 described above, the example has been shown in which the high-density layer 20*a* and the low-density layer 20*b* of the cylinder liner 20 are integrally formed by the three-dimensional molding machine. However, for example, the plurality of layers of the cylinder bore wall of the present disclosure that are different from each other in density, like the high-density layer 20*a* and the low-density layer 20*b*, may be formed so as to be divided into single layers or groups of an arbitrary number of layers in the cylinder axial direction. The plurality of layers can be finally combined when being incorporated into the cylinder block.

Embodiment 2

Figure 8:
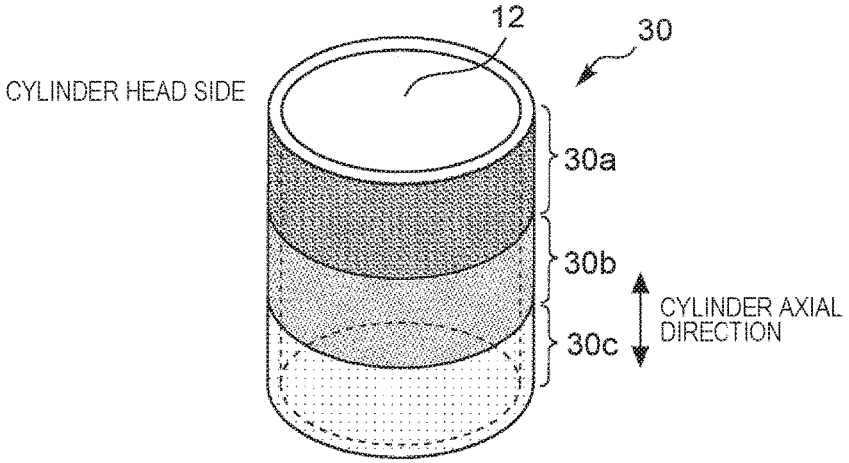
FIG. 8 is a perspective view representing a cylinder liner of a cylinder block according to Embodiment 2.

Next, Embodiment 2 of the present disclosure will be described with reference to FIG. 8. FIG. 8 is a perspective view representing a cylinder liner 30 of a cylinder block according to Embodiment 2 of the present disclosure. Except that the cylinder liner 20 is replaced with the cylinder liner 30, the cylinder block of this embodiment has the same configuration as the cylinder block 10 of Embodiment 1 described above.

As shown in FIG. 8, the cylinder liner 30 has a three-layer structure with the density varying in the cylinder axial direction. In this respect, the cylinder liner 30 is different from the cylinder liner 20 having the two-layer structure. Specifically, the cylinder liner 30 has a high-density layer 30*a*, a medium-density layer 30*b*, and a low-density layer 30*c* in this order from the side closer to the cylinder head 18 in the cylinder axial direction. The high-density layer 30*a* has a highest density, the medium-density layer 30*b* has a second highest density, and the low-density layer 30*c* has a lowest density. Because of this structure, in the cylinder liner 30 of this embodiment as a whole in the cylinder axial direction, too, the density of the layer located farther from the cylinder head 18 is lower than the density of the layer located closer to the cylinder head 18. More specifically, the density of the cylinder liner 30 decreases stepwise (e.g., in three steps) as the distance from the cylinder head 18 increases. The high-density layer 30*a* is the other example of a first layer. The medium-density layer 30*b* and the low-density layer 30*c* is the other example of a second layer.

To add further details, the high-density layer 30*a*, the medium-density layer 30*b*, and the low-density layer 30*c* are made of the same material. For example, the density of the high-density layer 30*a* is equivalent to the density of the cylinder bore wall located on an outer circumferential side of the cylinder liner 30. In the example shown in FIG. 8, as for the thicknesses of these layers, the high-density layer 30*a* is thickest, the medium-density layer 30*b* is second thickest, and the low-density layer 30*c* is thinnest. However, the ratio of the thicknesses of these three layers is not limited to this example, and may be set appropriately according to the difference in specification (e.g., a temperature distribution in a cylinder) of the internal combustion engine to which the present disclosure is applied. The cylinder liner 30 having the above three-layer structure can also be manufactured by the same technique as the cylinder liner 20 of Embodiment 1. Specifically, the lamination step of Embodiment 1 can be changed so that the density is varied twice in the cylinder axial direction.

According to the cylinder liner 30 of this embodiment having been described above, the number of the layers that are different from one another in density is increased from that of the cylinder liner 20 having the two-layer structure. Thus, it is possible to more finely (more flexibly) control how heat is transferred from the cylinder bore 12 to the cylinder bore wall at each portion of the cylinder bore wall in the cylinder axial direction. Even portions made of the same material undergo thermal expansion differently when these portions are different from each other in density. In this connection, provided that the densities of the layers located at both ends of the cylinder liner in the cylinder axial direction are set to be equal, the difference in density between adjacent layers can be reduced by increasing the number of the layers that are different from one another in density. As a result, the difference in thermal expansion at the border between the adjacent layers can be suppressed.

In Embodiment 2 described above, the cylinder liner 30 having the three-layer structure with the density varying in the cylinder axial direction has been shown as an example. However, for increasing the number of the layers that are different from one another in density, the number of the layers of the cylinder liner according to the present disclosure is not limited to three but may be four or more, provided that the density decreases stepwise as the distance from the cylinder head increases. For example, the configuration of the cylinder liner having an increased number of layers may be as shown in FIG. 9.

Figure 9:
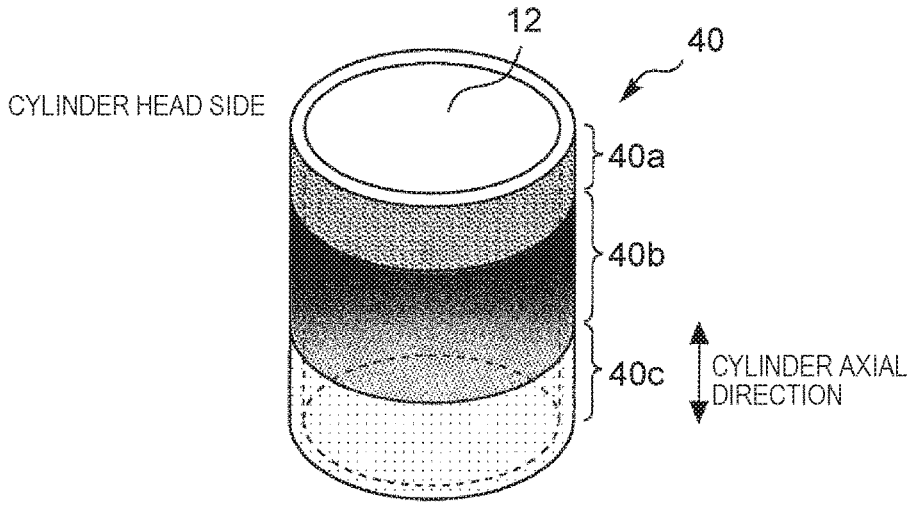
FIG. 9 is a perspective view representing a cylinder liner according to a modified example of Embodiment 2.

FIG. 9 is a perspective view representing a cylinder liner 40 according to a modified example of Embodiment 2 of the present disclosure. The cylinder liner 40 shown in FIG. 9 has a high-density layer 40*a*, a medium-density layer 40*b*, and a low-density layer 40*c* in this order from the side closer to the cylinder head 18 in the cylinder axial direction. The cylinder liner 40 is different from the cylinder liner 30 of Embodiment 2 in that the constitution of the medium-density layer 40*b* is different from the constitution of the medium-density layer 30*b*. Specifically, the medium-density layer 40*b* is not a layer of which the density is constant as with the medium-density layer 30*b*, but is a layer of which the density decreases gradually as the distance from the cylinder head 18 increases in the cylinder axial direction. According to the molding step described in Embodiment 1 that uses the three-dimensional molding machine, it is also possible to vary the density of each layer with one layer as a minimum unit. It is therefore also possible to substantially continuously vary the density of the cylinder liner in the cylinder axial direction. Thus, for example, the medium-density layer 40*b* can be manufactured using the above-described molding step. Alternatively, the cylinder liner may be configured so that the density varies substantially continuously, not only in the medium-density layer, but throughout the entire cylinder liner. The high-density layer 40*a* is the other example of a first layer. The medium-density layer 40*b* and the low-density layer 40*c* is the other example of a second layer.

Embodiment 3

Next, Embodiment 3 of the present disclosure will be described with reference to FIG. 10 to FIG. 12.

Configuration of Cylinder Block of Embodiment 3

Figure 10:
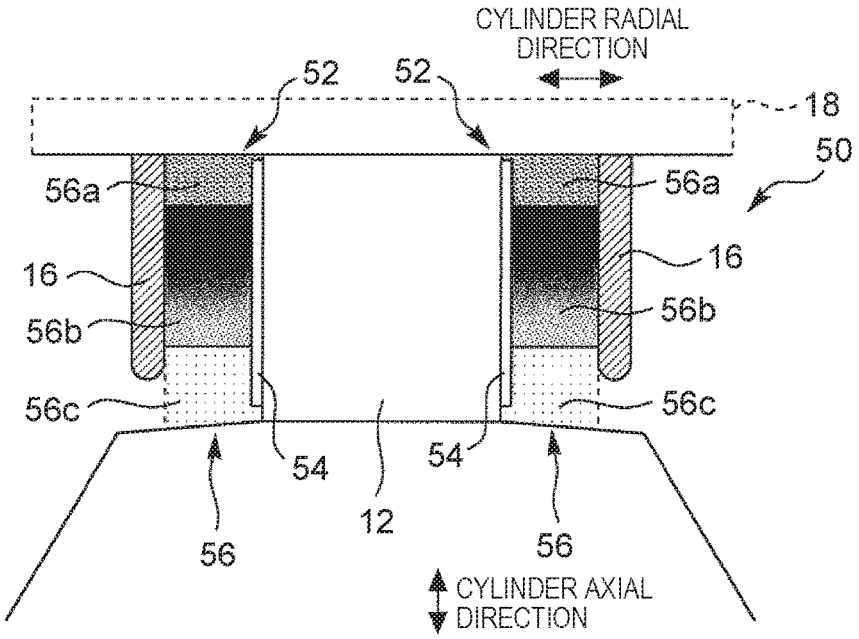
FIG. 10 is a view representing a sectional shape of a cylinder block of an internal combustion engine according to Embodiment 3.

FIG. 10 is a view representing a sectional shape (a sectional shape at a position equivalent to that of FIG. 2) of a cylinder block 50 of an internal combustion engine according to Embodiment 3 of the present disclosure. The cylinder block 50 of this embodiment is different from the cylinder block 10 of Embodiment 1 in the configuration of a cylinder bore wall 52.

The cylinder bore wall 52 of this embodiment includes a cylinder liner 54, and a main wall 56 that is located on an outer circumferential side of the cylinder liner 54, on the inner side of the water jacket 16 in the cylinder radial direction. In this embodiment, for example, the cylinder liner 54 is not composed of a plurality of layers that are different from one another in density, and instead, the main wall 56 is configured so that the density of a layer located farther from the cylinder head 18 is lower than the density of a layer located closer to the cylinder head 18 in the cylinder axial direction.

More specifically, for example, the main wall 56 has a high-density layer 56*a*, a medium-density layer 56*b*, and a low-density layer 56*c* in this order from the side closer to the cylinder head 18 in the cylinder axial direction, with the same settings of the density as in the cylinder liner 40 shown in FIG. 9. The high-density layer 56*a* is the other example of a first layer. The medium-density layer 56*b* and the low-density layer 56*c* is the other example of a second layer.

Manufacturing Method of Cylinder Block of Embodiment 3

Figure 11:
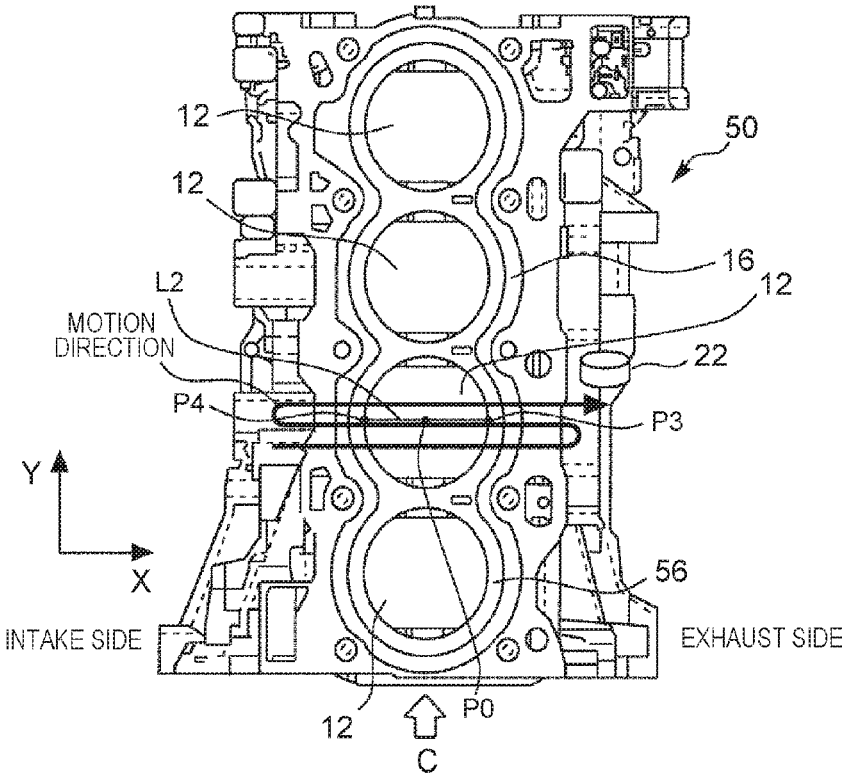
FIG. 11 is a view of a cylinder block as looked down from the cylinder head side in the cylinder axial direction.
Figure 12:
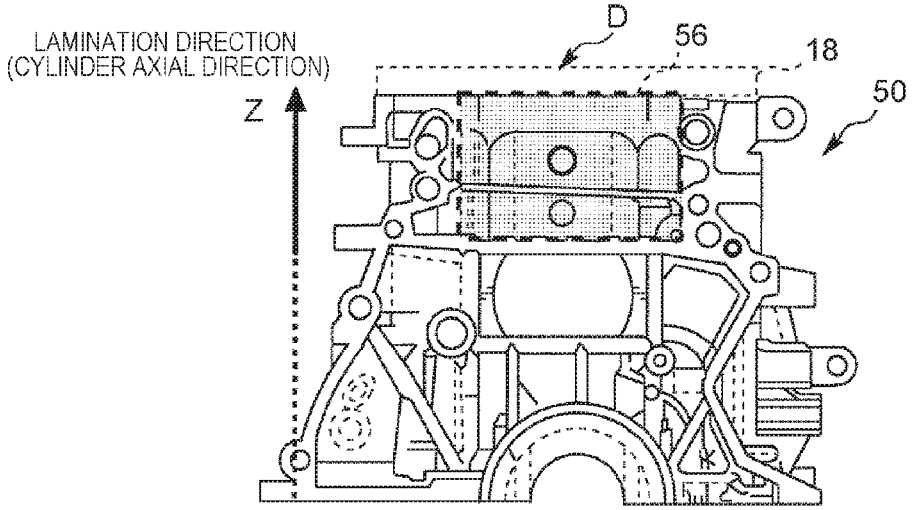
FIG. 12 is a view of the cylinder block as seen from the direction of the arrow C of FIG. 11.

FIG. 11 is a view of the cylinder block 50 as looked down from the side of the cylinder head 18 in the cylinder axial direction, and FIG. 12 is a view of the cylinder block 50 as seen from the direction of the arrow C of FIG. 11 (i.e., from one side in the array direction of the cylinder bores 12). In this embodiment, too, the Z-axis direction is a direction that is parallel to the cylinder axial direction and, for example, oriented from the side farther from the cylinder head 18 toward the side closer to the cylinder head 18.

Of the cylinder block 50 of this embodiment, a portion including the main wall 56 and excluding the cylinder liner 54 is manufactured using a three-dimensional molding machine. The portion of the cylinder block 50 excluding the cylinder liner 54 can be basically manufactured by performing the same molding step as the molding step described in Embodiment 1, with the object to be molded changed from the cylinder liner to that portion. In this embodiment, however, the "portion to be varied in density" of the cylinder block 50 in which the density is desired to be varied in the cylinder axial direction is the main wall 56 and not the entire cylinder block 50 excluding the cylinder liner 54, as indicated as a range D in FIG. 12. According to the three-dimensional molding machine including the molding head 22, even during the process of forming one layer of the object to be molded, it is possible to vary the density of one layer portion by portion by changing the filling ratio of the metal powder in the nozzle. In this embodiment, therefore, for a layer in which a portion corresponding to the main wall 56 in one layer and a portion corresponding to the outer circumference of the main wall 56 are present, the molding step is performed with only the portion corresponding to the main wall 56 regarded as the object to be varied in density. The cylinder liner 54 that is not the portion to be varied in density in this embodiment can be manufactured by any publicly known manufacturing method. The cylinder liner 54 can be inserted, for example, by press fitting, into the main wall 56 manufactured using the three-dimensional molding machine.

The X-axis direction used in the molding step of this embodiment is set so that, when the main wall 56 is seen from the cylinder axial direction as shown in FIG. 11, the main wall 56 faces the water jacket 16 at the positions of two points P3, P4 at which a straight line L2 passing through the cylinder bore center P0 and parallel to the X-axis and the outer circumference of the main wall 56 intersect with each other. In the example shown in FIG. 11, as in Embodiment 1, the X-axis direction is parallel to the direction connecting the intake side and the exhaust side of the internal combustion engine (the direction orthogonal to the array direction of the cylinder bores 12 as seen from the cylinder axial direction).

Effects of Embodiment 3

The configuration like that of the cylinder block 50 of this embodiment in which the density of the main wall 56 of the cylinder bore wall 52 is varied as described above can also suppress the heat conduction from the side closer to the cylinder head 18 toward the side farther from the cylinder head 18 in the cylinder axial direction.

As described above, the X-axis direction used in the molding step of this embodiment is set so that the main wall 56 faces the water jacket 16 at the positions of the two points P3, P4 at which the straight line L2 passing through the cylinder bore center P0 and parallel to the X-axis and the outer circumference of the main wall 56 intersect with each other. According to this setting of the X-axis direction, as already described as the effects of the liner incorporation step of Embodiment 1, heat transfer toward the outer side in the cylinder radial direction can be effectively promoted at a portion where this heat transfer is desired to be promoted (in the main wall 56, that portion is mainly the high-density layer 56*a*).

In Embodiment 3 described above, the example in which the density of the main wall 56 of the cylinder bore wall 52 is varied as described above has been shown. However, unlike in this example, the densities of both the cylinder liner and the main wall may be varied as described above.

In the case where the density of the main wall is varied, unlike in the example of the main wall 56, the main wall may be configured so as to have two or three layers that are different from one another in density in the cylinder axial direction as with the cylinder liner 20 or 30 of Embodiment 1 or 2.

In Embodiment 3 described above, the entire portion of the cylinder block 50 excluding the cylinder liner 54 is manufactured by the three-dimensional molding machine. However, unlike in this example, a manufacturing method may be used in which only the main wall of the portion of the cylinder block excluding the cylinder liner is manufactured using the three-dimensional molding machine, for example, and the manufactured main wall is installed to a main body of the cylinder block that is manufactured by casting.

The cylinder block for which the present disclosure is intended may be one that has a cylinder bore wall without a cylinder liner and is configured so that the density of the main wall of this cylinder bore wall is varied as described above.

Embodiment 4

Figure 13:
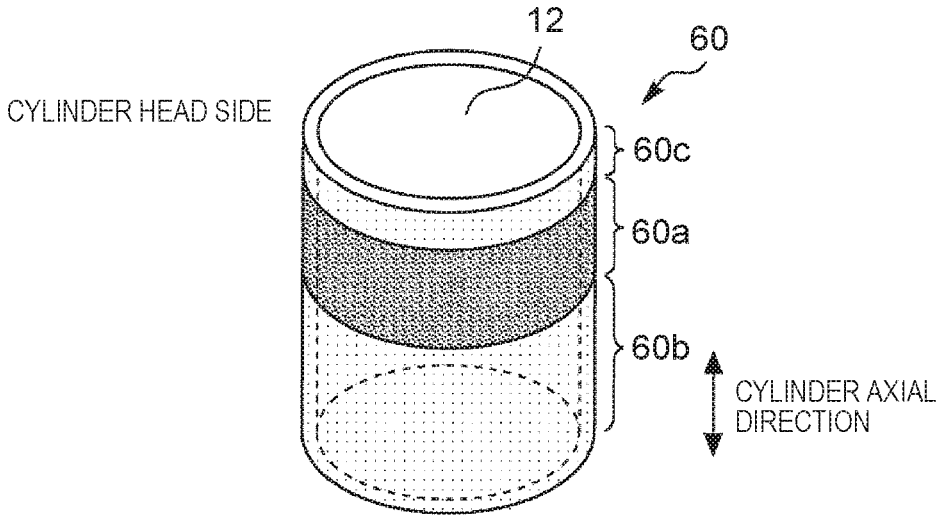
FIG. 13 is a perspective view representing a cylinder liner of a cylinder block according to Embodiment 4.

Next, Embodiment 4 of the present disclosure will be described with reference to FIG. 13. FIG. 13 is a perspective view representing a cylinder liner 60 of a cylinder block according to Embodiment 4 of the present disclosure. Except that the cylinder liner 20 is replaced with the cylinder liner 60, the cylinder block of this embodiment has the same configuration as the cylinder block 10 of Embodiment 1.

As shown in FIG. 13, the cylinder liner 60 has a three-layer structure with the density varying in the cylinder axial direction. In this respect, the cylinder liner 60 is different from the cylinder liner 20 having the two-layer structure. Specifically, the cylinder liner 60 has two layers, a high-density layer 60*a* and a low-density layer 60*b*, in this order from the side closer to the cylinder head 18, as a plurality of layers that are configured so that the density of a layer located farther from the cylinder head 18 is lower than the density of a layer located closer to the cylinder head 18 in the cylinder axial direction. The high-density layer 60*a* is a highest-density layer with a higher density of these two layers, and the low-density layer 60*b* is a layer having a density lower than that of the high-density layer 60*a*.

The cylinder liner 60 further includes a low-density layer 60*c* having a lower density than the high-density layer 60*a*, as a layer adjacent to the high-density layer 60*a* from the side closer to the cylinder head 18 relative to the high-density layer 60*a* in the cylinder axial direction. Thus, the cylinder liner 60 of this embodiment is configured so that the density of the layer located farther from the cylinder head 18 is lower than the density of the layer located closer to the cylinder head 18, not in the entire cylinder liner 60, but in one part of the cylinder liner 60 (i.e., the high-density layer 60*a* and the low-density layer 60*b*) in the cylinder axial direction. The low-density layer 60*c* is made of the same material as the high-density layer 60*a* and the low-density layer 60*b*.

According to the cylinder liner 60 of this embodiment having been described above, for the high-density layer 60*a* and the low-density layer 60*b*, heat conduction from the side closer to the cylinder head 18 toward the side farther from the cylinder head 18 in the cylinder axial direction can be suppressed as in Embodiment 1. Moreover, the cylinder liner 60 includes the low-density layer 60*c* farther on the side closer to the cylinder head 18 than the high-density layer 60*a* in the cylinder axial direction. According to this configuration, in an internal combustion engine that is required to suppress the above heat conduction as well as to suppress the heat transfer from the cylinder head 18 toward the cylinder block, both of these requirements can be satisfied.

In Embodiment 4 described above, the example has been shown in which only one part of the cylinder liner 60 in the cylinder axial direction (i.e., the high-density layer 60*a* and the low-density layer 60*b*) is configured so that the density of the layer located farther from the cylinder head 18 is lower than the density of the layer located closer to the cylinder head 18. However, unlike in this example, only one part in the cylinder axial direction of the main wall (e.g., the main wall 56) located on the outer circumferential side of the cylinder liner, on the inner side of the water jacket in the cylinder radial direction, may be configured so that the density of the layer located farther from the cylinder head is lower than the density of the layer located closer to the cylinder head. This main wall may include a low-density layer having a lower density than a highest-density layer that is located farthest on the side closer to the cylinder head inside that one part, and this low-density layer may be provided farther on the side closer to the cylinder head than that one part in the cylinder axial direction. This low-density layer may be made of the same material as the highest-density layer.

What is claimed is:

1. A cylinder block of an internal combustion engine, the cylinder block comprising a cylinder bore wall capable of holding a piston such that the piston reciprocates, wherein the cylinder block has a water jacket through which engine coolant flows, the cylinder bore wall includes a cylinder liner and a main wall, the main wall is located on an outer circumferential side of the cylinder liner and on an inner side of the water jacket in a cylinder radial direction, at least one part of the main wall in a cylinder axial direction includes a plurality of main wall layers that are different from one another in density, and the plurality of main wall layers include a first main wall layer and a second main wall layer, wherein the first main wall layer is located closer to a cylinder head in the cylinder axial direction than the second main wall layer and has a higher density than the second main wall layer.

2. The cylinder block of an internal combustion engine according to claim 1, wherein at least one part of the cylinder liner in the cylinder axial direction includes a plurality of cylinder liner layers that are different from one another in density.

3. The cylinder block of an internal combustion engine according to claim 1, wherein, in the at least one part of the main wall in the cylinder axial direction, a density of the main wall decreases stepwise as a distance from the cylinder head increases.

4. The cylinder block of an internal combustion engine according to claim 1, wherein at least one part of the cylinder liner in the cylinder axial direction includes a plurality of cylinder liner layers that are different from one another in density, a first cylinder liner layer is located closer to the cylinder head in the cylinder axial direction than a second cylinder liner layer and has a higher density than the second cylinder liner layer, and at least one of the main wall or the cylinder liner further includes a third layer closer to the cylinder head in the cylinder axial direction than the first main wall layer or the first cylinder liner layer, respectively, the third layer having a lower density than the first main wall layer or the first cylinder liner layer, respectively, and the third layer being made of the same material as the first main wall layer or the first cylinder liner layer, respectively.

* * * * *